US008561990B1

(12) United States Patent
Benson

(10) Patent No.: US 8,561,990 B1
(45) Date of Patent: Oct. 22, 2013

(54) PLAYING CARD MIRROR VIEWER

(76) Inventor: Robert W. Benson, Henderson, NV (US)

( * ) Notice: Subject to any disclaimer, the term of this patent is extended or adjusted under 35 U.S.C. 154(b) by 0 days.

(21) Appl. No.: 12/705,808

(22) Filed: Feb. 15, 2010

Related U.S. Application Data

(60) Provisional application No. 61/207,437, filed on Feb. 13, 2009.

(51) Int. Cl.
*A63F 1/10* (2006.01)

(52) U.S. Cl.
USPC ..... 273/150

(58) Field of Classification Search
USPC ..... 273/150
See application file for complete search history.

(56) References Cited

U.S. PATENT DOCUMENTS

| | | | | |
|---|---|---|---|---|
| 2,495,528 | A | 1/1950 | Langan | |
| 4,146,229 | A | 3/1979 | Morse | |
| 4,346,895 | A | 8/1982 | Brownlee | |
| 4,991,331 | A * | 2/1991 | James | 40/443 |
| 5,590,880 | A | 1/1997 | Flam | |
| 6,010,225 | A * | 1/2000 | Lerner et al. | 359/872 |
| 6,120,026 | A | 9/2000 | Whitney et al. | |
| 6,638,161 | B2 * | 10/2003 | Soltys et al. | 463/12 |
| 7,390,256 | B2 * | 6/2008 | Soltys et al. | 463/12 |
| 7,594,661 | B2 * | 9/2009 | McLaughlin, Jr. | 273/150 |
| 7,669,851 | B2 * | 3/2010 | Blake | 273/148 R |
| 7,686,681 | B2 * | 3/2010 | Soltys et al. | 463/11 |
| 7,694,968 | B2 * | 4/2010 | Sims et al. | 273/148 R |
| 2006/0150460 | A1 | 7/2006 | Lowe et al. | |

* cited by examiner

*Primary Examiner* — Kurt Fernstrom
*Assistant Examiner* — Dolores Collins
(74) *Attorney, Agent, or Firm* — Montgomery Patent & Design; Robert C. Montgomery

(57) ABSTRACT

An apparatus that holds playing cards is herein disclosed, employing a mirror system therein a housing to allow only the holder of the cards to view them, while reducing the holding and movement of the cards. To use, a user would slide the cards face-down from below onto a level surface of the apparatus. Once in place, a set of mirrors would be used to allow only the player to see the value on face of the cards. This feature restricts other players to view the cards and also reduces the possibility of "body language" providing clues as to the value of the cards. Additionally, the apparatus allows players without the use of their hands or arms to play a game of cards as well. Also, cards would not be subject to damage from frequent bending and lifting.

18 Claims, 3 Drawing Sheets

PLAYING CARD MIRROR VIEWER

RELATED APPLICATIONS

The present invention was first described in and claims the benefit of U.S. Provisional Application No. 61/207,437, filed Feb. 13, 2009, the entire disclosures of which are incorporated herein by reference.

FIELD OF THE INVENTION

The present invention relates generally to the field of playing cards, and in particular, to a device specially adapted for the covert viewing of face-down playing cards in a manner which is easily utilizable by those with disabilities.

BACKGROUND OF THE INVENTION

Playing cards remain a popular source of entertainment and intellectual stimulation. An endless variety of card games utilize a standard deck of cards in a variety of ways. Many popular games and game variants require those participating to conceal their cards from their opponents while viewing the cards themselves. This creates an interesting scenario in which each player has imperfect information, making for exciting and popular games.

Concealing one's facedown cards from opponents while viewing them is not a trivial task, and is especially difficult for those with disabilities to arms, hands, or the like who have trouble manipulating cards. Also, frequent re-checking of the cards in such a scenario can lead to great wear-and-tear on the cards themselves. This process requires enough precision and manual dexterity that it contributes a great amount of stress, time, and effort to an extended game of cards. For those with disabilities, an assisting person who is not able to participate in the game may be required simply for purposes of card manipulation.

Various attempts have been made to provide objects which assist in the holding and viewing of cards. Examples of these attempts can be seen by reference to several U.S. patents. U.S. Pat. No. 2,495,528, issued in the name of Langan, describes a projecting and viewing device. The Langan device utilizes a projector and screen to view microfilm information and the like which is stored on cards.

U.S. Pat. No. 4,346,895, issued in the name of Brownlee, describes a playing card caddy. The Brownlee device contains a plurality of pockets for the holding of playing cards and displaying of information to a player once a hand has been dealt, preventing the need for constant manipulation and support of the cards.

U.S. Pat. No. 5,590,880, issued in the name of Flam, describes a playing card holder. The Flam device provides a means of support a dealt hand of cards during playing in a hands-free and easily accessible manner.

While these devices fulfill their respective, particular objectives, each of these references suffer from one (1) or more of the aforementioned disadvantages. Many such devices do not provide a secure, personalized view of a player's hand of cards. Also, many such devices are not easily transported or manipulated once set up. Furthermore, many such devices are not easily operable in a discrete manner by another player at the table, such as may be necessary when assisting a disabled player. Accordingly, there exists a need for a playing card holder and viewer without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to allow a user to view a concealed hand of cards in a discrete manner which allows another person at the table to easily and unobtrusively assist that player in the placement of the cards. Thus, the object of the present invention is to solve the aforementioned disadvantages and provide for this need.

To achieve the above objectives, it is an object of the present invention to provide a means for holding, protecting, and concealing playing cards in a manner which allows a user to privately view the cards' values. The apparatus comprises a forward housing, a rearward housing, a card slot, a first mirror, and a second mirror.

Another object of the present invention is to comprise the forward and rearward housings of a means to protect and encompass the first and second mirrors. The forward and rearward housings comprise a unitary "L"-shaped structure fabricated from a resilient, opaque material such as polypropylene, metal, or the like.

Yet still another object of the present invention is to locate the first mirror within the rearward housing at a central lower position, oriented at an angle which enables the projected image from the playing cards to create a first reflected image onto the second mirror.

Yet still another object of the present invention is to locate the second mirror at an internal vertical position below the card slot and opposing the first mirror, oriented at an angle which enables the mirror to create a second reflected image from the first mirror and which enables a user to view the second reflected image.

Yet still another object of the present invention is to comprise a viewing compartment which provides a means to privately observe the second reflected image. The viewing compartment comprises a protruding portion of the forward housing with respect to the rearward housing at a slight upward angle in order to limit peripheral viewing of the playing card images.

Yet still another object of the present invention is to comprise a card slot which provides a placement means for playing cards. In a preferred embodiment, the card slot is large enough to hold up to thirteen (13) cards simultaneously. The slot is located on a rear intermediate portion of the rearward housing. A front portion of the card slot is beveled to provide easy sliding placement of the cards.

Yet still another object of the present invention is to comprise a card stop along an inner edge of the card slot inside the rearward housing in order to limit the insertion depth of the cards. In use, a user places the cards inside the slot until an edge of the card abuts the card stop, enabling a front portion of the card to project an image onto the first mirror.

Yet still another object of the present invention is to utilize first and second mirrors such that the image of the cards is reversed by the first mirror into the first reflected image. The first reflected image is then reversed by the second mirror into the second reflected image. The second reflected image is viewed by the user and shows the playing cards in their proper image as if directly viewed.

Yet still another object of the present invention is to provide a method of utilizing the device that provides a unique means of allowing a user to orient the invention for ease of viewing, allowing another person to easily place the cards in position on the invention in a manner which does not risk accidental viewing or exposure of the cards, and allowing the user to easily and repeatedly view the cards without need for manual manipulation while preventing opponents from viewing the cards' values.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
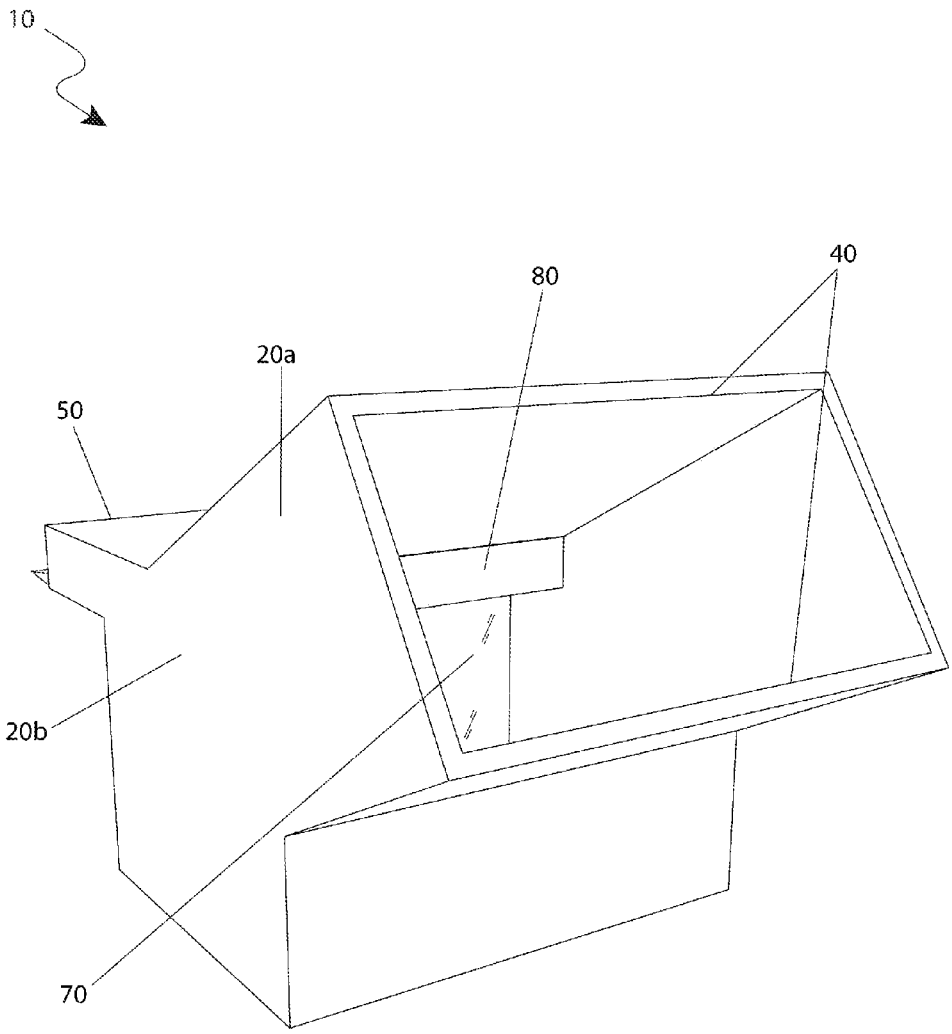
FIG. 1 is a perspective view of a playing card mirror viewer 10, according to a preferred embodiment of the present invention.

10 playing card mirror viewer
20*a* forward housing
20*b* rearward housing
35 playing card
40 viewing compartment
50 card slot
55 adhesive
60 first mirror
63 projected image
64 first reflected images
65 second reflected image
70 second mirror
80 card stop

DETAILED DESCRIPTION OF THE PREFERRED EMBODIMENT

Figure 2:
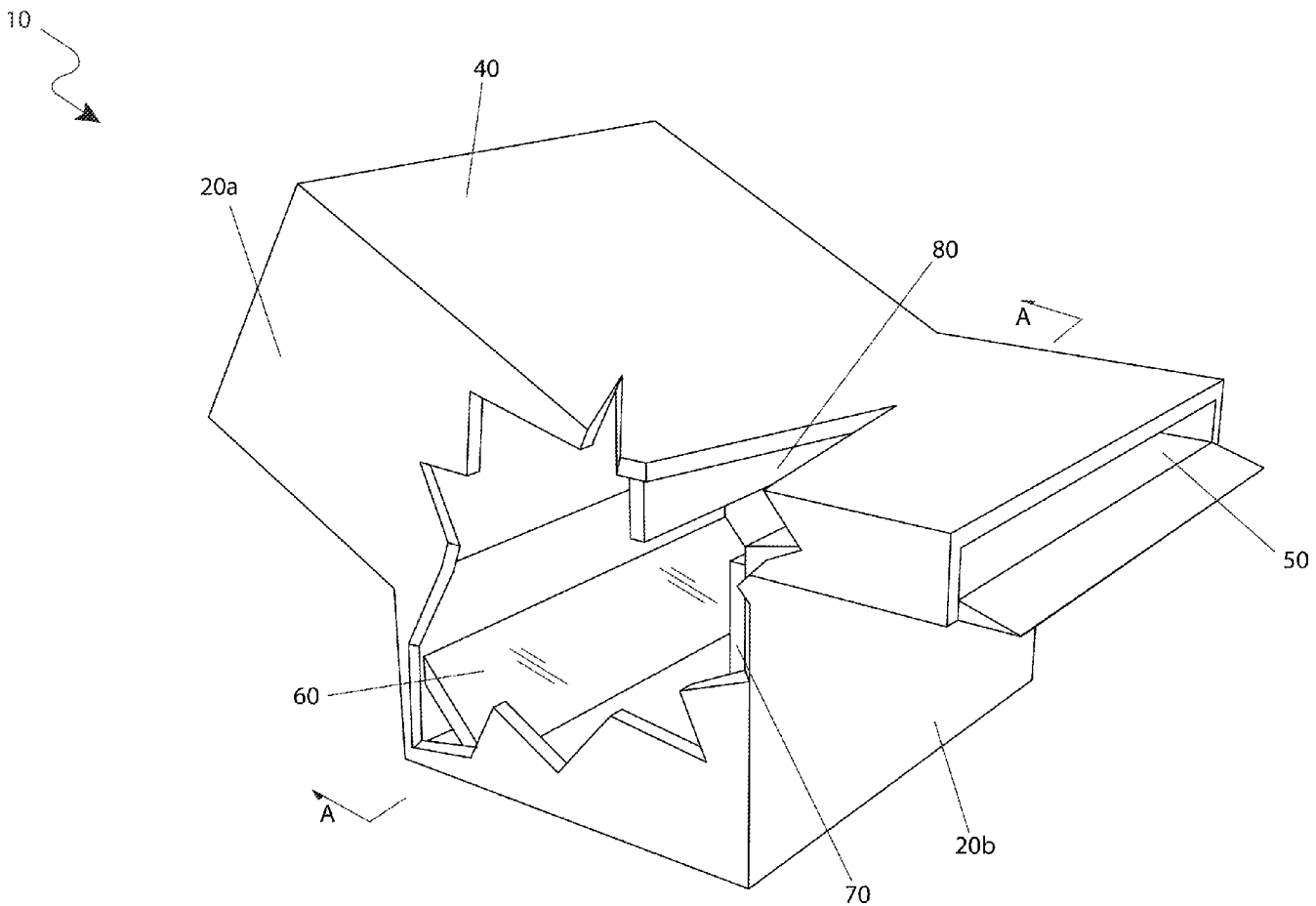
FIG. 2 is a perspective break-away view of the playing card mirror viewer 10, according to a preferred embodiment of the present invention; and, FIG. 3 is a section view of the playing card mirror viewer 10 taken along section line A-A (see FIG. 2), according to a preferred embodiment of the present invention.
Figure 3:
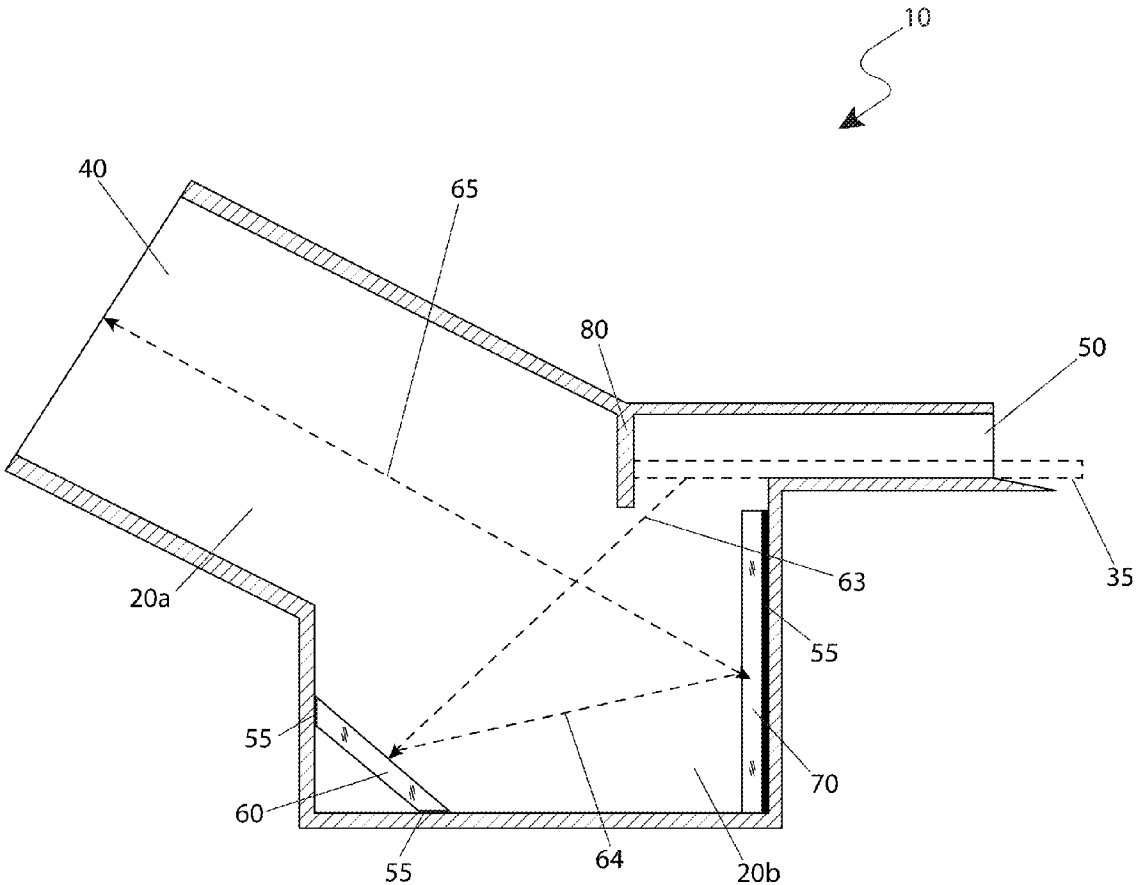

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a playing card mirror viewer 10 (herein described as the "apparatus") 10, which provides a means for holding, protecting, and concealing playing cards 35 without damage and also providing a user to view the playing card 35 values in a inconspicuous manner. The apparatus 10 comprises a forward housing 20*a*, a rearward housing 20*b*, a card slot 50, and a first mirror 60, and a second mirror 70. Said apparatus 10 is preferably utilized with existing conventional playing cards 35 which are utilized in commercial and residential gaming. Said apparatus 10 is ideal for handicapped users or other persons with arm/hand limitations.

Referring now to FIG. 1, a perspective view of the apparatus 10 and FIG. 2, a perspective break-away view of the apparatus 10, according to the preferred embodiment of the present invention, are disclosed. The apparatus 10 comprises a forward housing 20*a* and rearward housing 20*b*, thereby providing a protective enclosure for a first mirror 60 and a second mirror 70. The forward housing 20*a* and rearward housing 20*b* comprise a unitary structure further comprising a generally "L"-shape further comprising dimensions approximately measuring six (6) inches square by four (4) inches deep. Said forward housing 20*a* and rearward housing 20*b* are fabricated in an injection molding process from opaque materials such as, but not limited to: acrylonitrile butadiene styrene (ABS), polypropylene, metals, or the like. Said materials should be opaque thereto conceal the playing card 35 values from opponents. The forward housing 20*a* and rearward housing 20*b* are also fabricated out of sturdy and resilient materials to protect the internal fragile components.

The apparatus 10 comprises a first mirror 60, thereby enabling a first reflected image 64 to be projected. The first mirror 60 is located within the rearward housing 20*b* at a central lower position and oriented at an appropriate angle, thereby enabling the projected image 63 therefrom the playing cards 35 to create a first reflected image 64 thereonto a second mirror 70. Said first mirror 60 is adhered to an internal side and bottom surface via adhesive 55, yet other adhering means may be provided without limiting the functions of the apparatus 10.

The apparatus 10 also comprises a second mirror 70, thereby enabling the first reflected image 64 to be projected and further create a second reflected image 65. The second mirror 70 is situated at an internal vertical position below a card slot 50 and opposing the first mirror 60, thereby allowing the user to view the second reflected image 65. The second mirror 70 is also adhered to the internal vertical surface via adhesive 55, yet other adhering means may be utilized without limiting the functions of the apparatus 10. Each mirror 60, 70 is an identical width as the apparatus 10 and are fabricated from a plane mirror, but other devices providing specular reflection may be incorporated.

The apparatus 10 also comprises a viewing compartment 40, thereby providing a means to privately observe the second reflected image 65 of the playing cards 35. The viewing compartment 40 comprises a protruding portion of the forward housing 20*a* at a slight angle from the rearward housing 20*b* to limit a peripheral view thereof the second reflected image 65. The viewing compartments 40 back and side portions are also enclosed thereto limit the view of the projected second reflected image 65. The viewing compartment is preferably situated in such a way to limit the view of the second reflected image 65 only to the user.

Referring now to FIG. 3, a section view of the apparatus 10, according to the preferred embodiment of the present invention, is disclosed. The apparatus 10 comprises an integrally molded card slot 50, thereby providing a placement means for playing cards 35. The card slot 50 holds up to thirteen (13) playing cards 35, yet other sizes may be utilized which would allow the use of more and/or fewer playing cards 35. Once a hand of playing cards 35 has been dealt, the user positions said playing cards 35 face down thereonto the card slot 50 and thereagainst a card stop 80, thereby enabling said playing cards 35 to project an image 63 thereonto the first mirror 60, which then reverses the projected image 63 into a first reflected image 64. The second mirror 70 reverses the first reflected image 64 to a second reflected image 65 therethrough the viewing compartment 40. The second reflected image 65 shows the playing cards 35 proper image as if they were directly viewed. The card stop 80 limits the insertion depth of the playing cards 35. Said card stop 80 comprises an integrally molded portion of the housing members 20*a*, 20*b* in a perpendicular orientation from an inward horizontal portion thereof. A front portion of the card slot 80 is preferably beveled outward for effortless insertion and removal of playing cards 35. Said card slot 80 is located thereon a rear intermediate portion of the apparatus 10 and is fabricated from a translucent material such as, but not limited to: glass, acrylic glass, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; placing the apparatus 10 thereon a level surface; placing a desired amount of playing cards 35 face down thereon the card slot 50 and against the card stop 80, thereby allowing said playing cards 35 to project an image 63 thereonto the first mirror 60; viewing the second reflected image 65 of the playing cards 35 by the second mirror 70 by means of the viewing compartment 40 therein the first mirror 60; reversing the projected image 63 into a first reflected image 64; reversing the first reflected image 64 to a second reflected image 65 by means of the second mirror 70 therethrough the viewing compartment 40; viewing the playing cards 35 proper image as if they were directly viewed by means of the second reflected image 65; removing playing cards 35 from card slot 50 when finished; and, enabling only the holder of the playing cards 35 to view their values and reducing the holding and movement of said playing cards 35, thereby utilizing the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A viewing apparatus for at least one playing card comprises:

a housing, comprising a forward portion and a rearward portion;

a mirror assembly housed within said rearward portion; and, a viewing means located within said forward portion;

wherein said at least one playing card is placed upon said housing such that said mirror assembly is in view thereof;

wherein said mirror assembly reflects a projected image of said at least one playing card toward said viewing means;

wherein said viewing means allows a user to view said reflected projected image;

wherein said viewing apparatus provides a concealing means for said at least one playing card from an opposing player or players;

wherein said housing comprises a unitary structure comprising opaque materials on outer surfaces thereof, thereby preventing surreptitious or unauthorized viewing of said at least one playing card by said opposing player or players; and, wherein said forward portion upwardly and forwardly projects from said rearward portion.

2. The viewing apparatus of claim 1, wherein said housing further comprises dimensions of approximately six square inches and four inches in depth.

3. The viewing apparatus of claim 1, wherein said housing further comprises:

said forward portion comprising a hollow box-like structure having a pair of side walls, an upper wall, and a bottom wall;

said rearward portion comprising a hollow box-like structure having a pair of side walls coextensive with said pair of side walls of said forward portion, a bottom wall, a front wall extending downwardly from said front wall of said forward portion, and a rear wall; and, a card slot portion, extending outwardly from a rearward location of said housing, comprising a pair of side walls, a bottom wall outwardly extending from an upper edge of said rear wall of said rearward portion, an upper wall extending from a bottom edge of said upper wall of said forward portion, and a card stop internally located and vertically depending downward from an internal surface of said upper wall of said forward portion at a distance away from said bottom wall, thereby providing a placement means for said at least one playing card thereon;

wherein said viewing means is located within an upper end of said forward portion to prevent surreptitious or unauthorized viewing of said image of said at least one playing card;

wherein said at least one playing card is placed face down within said card slot on said upper surface of said bottom wall in view of said mirror assembly; and, wherein said card stop provides an abutment for said at least one playing card when placed within said card slot.

4. The viewing apparatus of claim 3, wherein a rear end of said bottom wall of said card slot is beveled.

5. The viewing apparatus of claim 3, wherein said mirror assembly further comprises:

a first mirror placed within an interior of said rearward portion and situated in view of said at least one playing card as placed within said card slot; and, a second mirror placed within an interior of said rearward portion and situated in view of said first mirror and said viewing means;

wherein said first mirror receives a projected image of said at least one playing card and produces a first reflected image;

wherein said second mirror receives said first reflected image and produces said second reflected image; and, wherein said viewing means receives said second reflected image.

6. The viewing apparatus of claim 3, wherein said viewing means comprises said upper end of said forward portion that protrudes at a slight angle from said rearward portion.

7. The viewing apparatus of claim 5, wherein said first mirror is placed on an angle within a corner of said bottom wall and said front wall of said rearward portion and extending an entire width of said interior of said rearward portion.

8. The viewing apparatus of claim 7, wherein said first mirror is adhesively bonded to said rearward portion.

9. The viewing apparatus of claim 7, wherein said second mirror is placed against said rear wall of said rearward portion terminating prior to said card lot and extending an entire width of said interior of said rearward portion.

10. The viewing apparatus of claim 9, wherein said second mirror is adhesively bonded to said rearward portion.

11. A viewing apparatus for at least one playing card comprises:

a housing, comprising a forward portion and a rearward portion, wherein said at least one playing card is placed upon;

a first mirror adhesively bonded within an interior of said rearward portion and situated in view of said at least one playing card when placed upon said housing, wherein said first mirror receives a projected image of said at least one playing card and produces a first reflected image;

a second mirror adhesively bonded within an interior of said rearward portion and situated in view of said first mirror, wherein said second mirror receives said first reflected image and produces said second reflected image; and, a viewing means located within said forward portion, wherein said viewing means receives said second reflected image;

wherein said viewing means allows a user to view said second reflected image; and, wherein said viewing apparatus provides a concealing means for said at least one playing card from an opposing player or players.

12. The viewing apparatus of claim 11, wherein said housing further comprises said forward portion upwardly and forwardly projecting from said rearward portion and comprising a unitary structure comprising opaque materials on outer surfaces thereof, thereby preventing surreptitious or unauthorized viewing of said at least one playing card by said opposing player or players.

13. The viewing apparatus of claim 12, wherein said housing further comprises dimensions of approximately six square inches and four inches in depth.

14. The viewing apparatus of claim 13, wherein said housing further comprises:

said forward portion comprising a hollow box-like structure having a pair of side walls, an upper wall, and a bottom wall;

said rearward portion comprising a hollow box-like structure having a pair of side walls coextensive with said pair of side walls of said forward portion, a bottom wall, a front wall extending downwardly from said front wall of said forward portion, and a rear wall; and, a card slot portion, extending outwardly from a rearward location of said housing, comprising a pair of side walls, a bottom wall outwardly extending from an upper edge of said rear wall of said rearward portion, an upper wall extending from a bottom edge of said upper wall of said forward portion, and a card stop internally located and vertically depending downward from an internal surface of said upper wall of said forward portion at a distance away from said bottom wall, thereby providing a placement means for said at least one playing card thereon;

wherein said viewing means is located within an upper end of said forward portion to prevent surreptitious or unauthorized viewing of said image of said at least one playing card;

wherein said at least one playing card is placed face down within said card slot on said upper surface of said bottom wall in view of said mirror assembly; and, wherein said card stop provides an abutment for said at least one playing card when placed within said card slot.

15. The viewing apparatus of claim 14, wherein a rear end of said bottom wall of said card slot is beveled.

16. The viewing apparatus of claim 14, wherein said first mirror is placed on an angle within a corner of said bottom wall and said front wall of said rearward portion and extending an entire width of said interior of said rearward portion.

17. The viewing apparatus of claim 14, wherein said second mirror is placed against said rear wall of said rearward portion terminating prior to said card lot and extending an entire width of said interior of said rearward portion.

18. The viewing apparatus of claim 14, wherein said viewing means comprises said upper end of said forward portion that protrudes at a slight angle from said rearward portion.

* * * * *